United States Patent [19]

Albon et al.

[11] Patent Number: 4,971,024

[45] Date of Patent: Nov. 20, 1990

[54] COOKING HOBS

[75] Inventors: Philip Albon; Leslie Smith, both of Warrington, England

[73] Assignee: New World Domestic Appliances Limited, Warrington, England

[21] Appl. No.: 475,991

[22] Filed: Feb. 6, 1990

[51] Int. Cl.[5] ..... F24C 3/00

[52] U.S. Cl. ..... 126/39 B; 126/39 R; 126/214 A

[58] Field of Search ..... 126/39 R, 39 B, 39 H, 126/39 K, 214 R, 214 A

[56] References Cited

U.S. PATENT DOCUMENTS 3,633,562 1/1972 Morse ..... 126/214 R 4,846,144 7/1989 Krohn et al. ..... 126/214 R

*Primary Examiner*—Carroll B. Dority

*Attorney, Agent, or Firm*—Shlesinger & Myers

[57] ABSTRACT

A cooking hob comprises a glass top in which is disposed a plurality of gas burners and or electric hotplates, the glass top being supported on the top surface of an open-bottomed rectangular box-like structure, a base plate of which is removable for access purposes.

6 Claims, 3 Drawing Sheets

COOKING HOBS

This invention relates to cooking hobs of the kind which includes a glass or similar material top in which a plurality of gas burners and/or electric hotplates or a combination thereof are inset. Such cooking hobs are primarily designed for fitting in a kitchen work surface.

In such cooking hobs there is always the possibility that the glass top could shatter and steps must be taken to minimise the damage which can be caused to the hob should this happen and also minimise the risk that a user of the cooking hob may be exposed to should the glass top shatter.

In one particular glass topped cooking hob which is commercially available, the glass top of the cooking hob is supported on an open-topped shallow rectangular metal box, in which box the gas burners and/or electric hotplates are disposed. Such a construction is very disadvantageous should the glass top shatter because the shattered glass would fall into the metal box and any cooking implement which happened to be on the hob at the time could topple over and spill its contents into the box. With the glass top shattered, because the box is open-topped, the contents thereof would be accessible to a user, and thus any live electrical connections within the box could be dangerous. Also the fact that the metal box is open-topped means that if any servicing of the cooking hob is required, the glass top, which is normally sealed to the surrounding kitchen work surface, has to be removed which is not ideal.

It is an object of the present invention to provide a glass topped cooking hob in which the aforesaid disadvantages are substantially overcome.

An exemplary embodiment of the invention will now be described reference being made to the accompanying drawings, in which.

Figure 1:
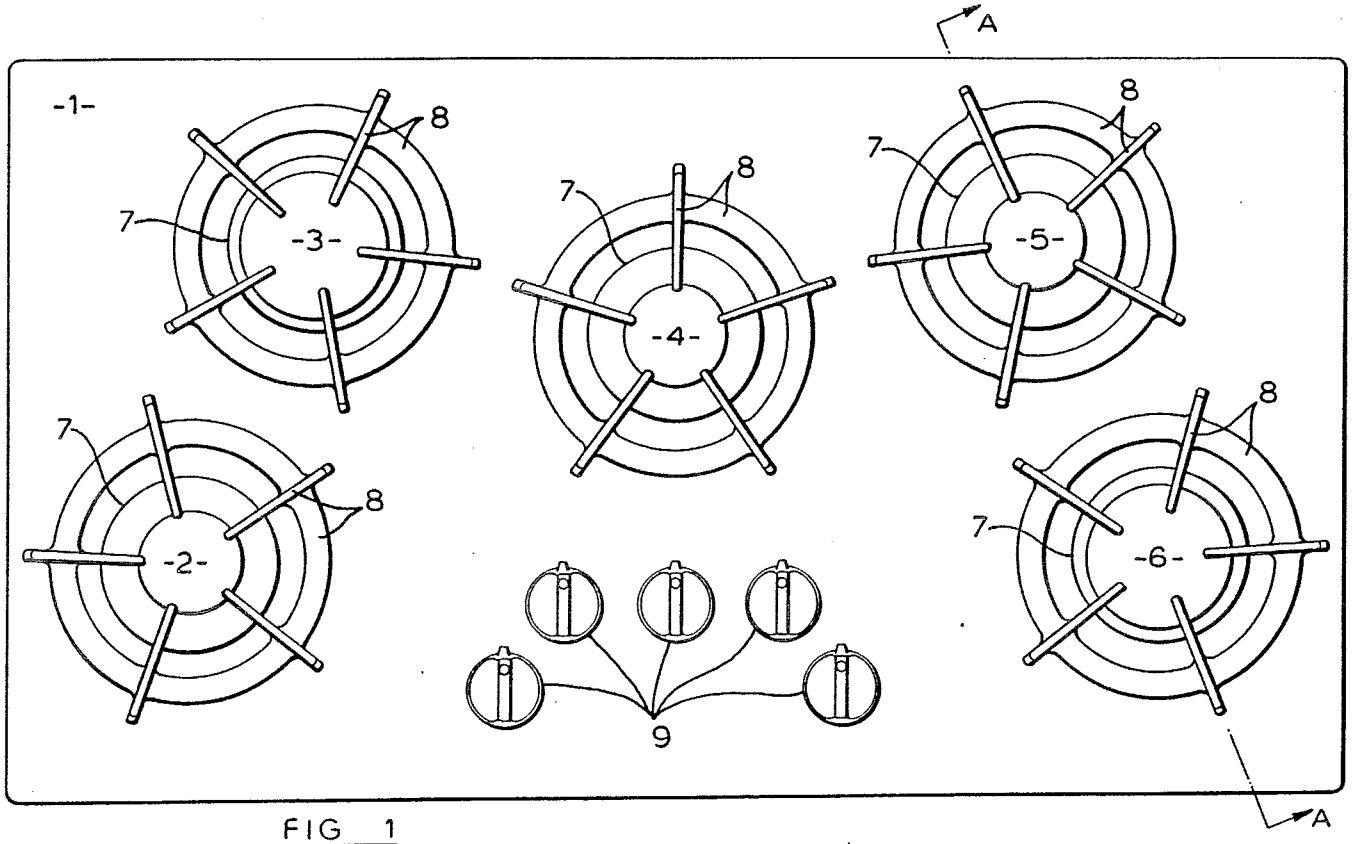
FIG. 1, is a top view of a cooking hob in accordance with the present invention.

The cooking hob shown in FIG. 1 of the drawings comprises a glass top 1 which is provided with five equal diameter holes (not shown) in which are respectively disposed five gas burners 2, 3, 4, 5 and 6, each of which is surrounded by an inset spillage bowl 7 and a pan support 8. It will be noted that the gas burners 3 and 6 are larger than the gas burners 2, 4 and 5. It will be appreciated that the gas burners 2 to 6 may be of any required size, and the number of gas burners may be more than or less than the five shown. The cooking hob of FIG. 1 is also provided with five gas control taps 9 corresponding to respective ones of the gas burners 2 to 6, for controlling the supply of gas to the respective gas burners 2 to 6.

Although in the cooking hob of FIG. 1, five gas burners are shown, it should be appreciated that the present invention is equally applicable to an electric cooking hob in which the gas burners 2 to 6 would be replaced by electric hotplates, and also to so-called dual fuel cooking hobs in which a combination of gas burners and electric hotplates is provided.

Figure 2:
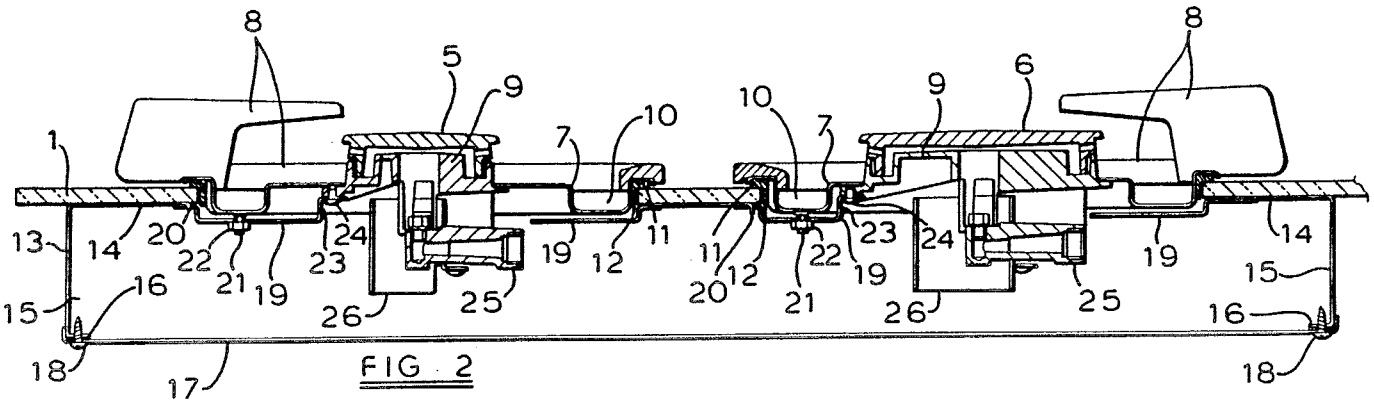
FIG. 2, is a diagrammatic cross-sectional side view on the lines A—A of FIG. 1, and FIG. 3, in an underneath view of the cooking hob with the base plate thereof removed.

In FIG. 2 of the drawings there is shown a cross-sectional side view along the lines A—A of the cooking hob of FIG. 1. In FIG. 2 the glass top 1 is shown having two holes in it for receiving the gas burners 5 and 6 each with a surrounding inset spillage bowl 7 surmounted by a pan support 8.

Each of the spillage bowls 7 is of circular form with a central hole through the underside of which is received the base part 9 of the gas burners 5 and 6. The spillage bowls 7 are also provided with a circular spillage channel 10 and a surrounding lipped portion 11 which overlies the glass top and which is separated from it by a resilient sealing gasket 12.

The glass top 1 of the cooking hob is supported on an open-bottomed shallow metallic box-like structure 13 which is provided with a top surface 14 which is in contact with and underlies the glass top 1, and downwardly depending side walls 15 which are provided with inward flanges 16 at their lower extremities, to which flanges 16 a removable base plate 17 is secured by means of screws 18.

The top surface 14 of the box structure 13 is provided with holes corresponding to the holes in the glass top 1 in which the gas burners 5 and 6 and their surrounding spillage bowls 7 are disposed. Beneath each of the holes in the top surface 14 is provided a dished annular clamping plate 19 to which the respective base part of the gas burners 5 and 6 is attached, and the clamping plates 19 are clamped to the spillage bowls 7 as will be described, so that the glass top 1 and the sealing gasket 12 are sandwiched between them.

Each of the clamping plates 19 is located on the underside of the top surface 14 by means of three circumferentially spaced, downwardly depending lugs 20 which locate in corresponding holes in the clamping plate 19. Each of the spillage bowls 7 is provided on the underside of the spillage channel 10 thereof with three circumferentially spaced downwardly depending threaded studs 21 which extend through corresponding holes in the clamping plate 19, each of the studs 21 being provided with a nut 22 which is rotated to clamp the spillage bowl 7 and the clamping plate 19 together.

In the centre of each of the clamping plates 19 is provided three inwardly and upwardly extending, circumferentially spaced fingers 23 to which the base part 9 of a respective one of the gas burners 5 and 6 is attached by means of screws 24. Each of the base parts 9 of the gas burners 5 and 6 is provided with a gas input connection 25 to which is coupled a gas supply pipe as will be described with reference to the underneath view of FIG. 3.

It has been found that in use of the gas cooking hob as described, it is necessary to minimise the effects of air flow across each of the gas burners 2 to 6 in order the minimise the disturbance which this can cause to the gas injection performance of the burner. This is achieved by providing each of the gas burners 2 to 6 with a "U" shaped shield 26 which is secured to the base part 9 of the burner and substantially surrounds the respective burner.

Figure 3:
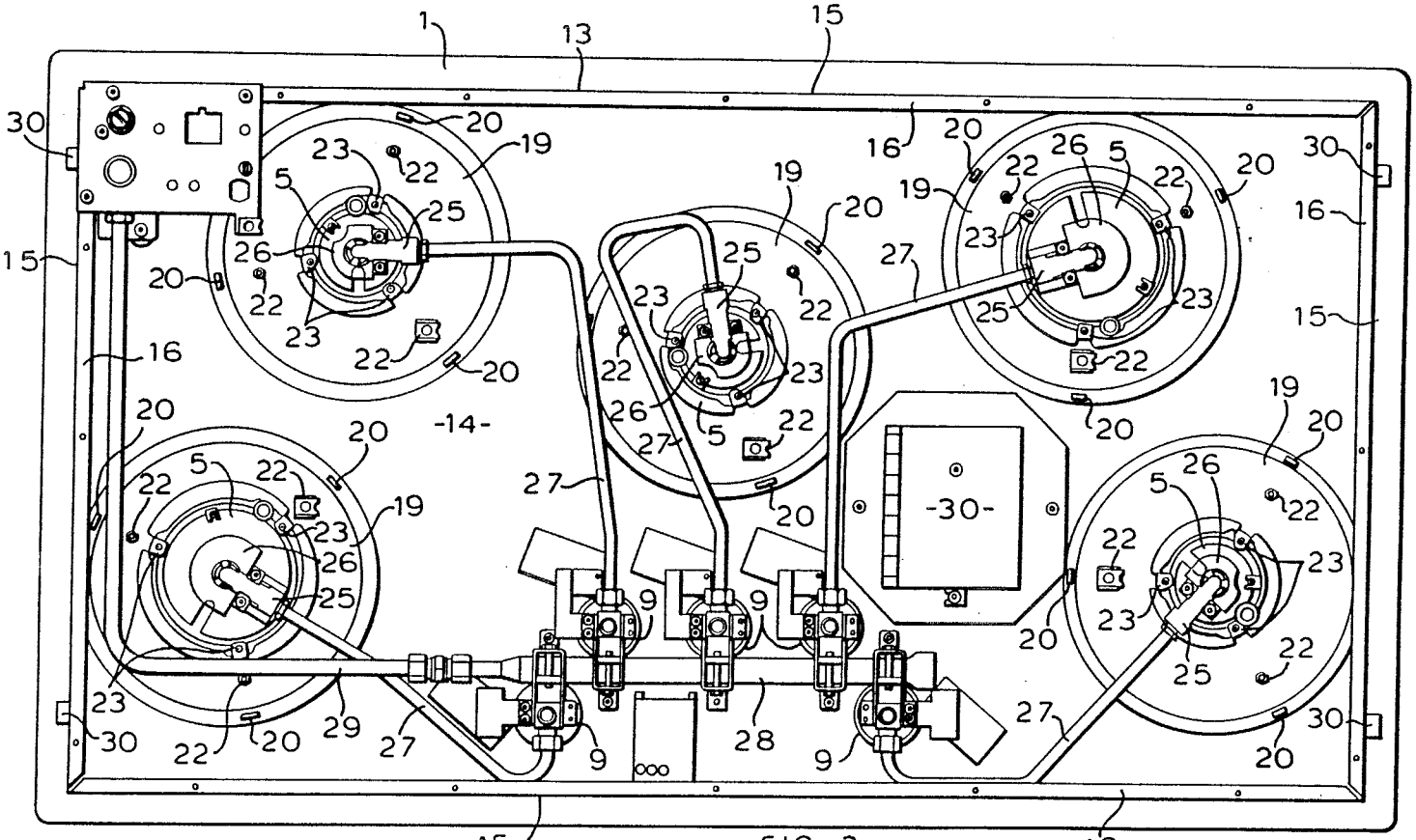

In FIG. 3 of the drawings there is shown an underneath view of the cooking hob described with reference to FIGS. 1 and 2 with the base plate 17 removed. In FIG. 3, the glass top 1 is shown secured to the box structure 13, the structure 13 having side walls 15 and inward flanges 16. The clamping plates 19 associated with each of the gas burners 2, 3, 4, 5 and 6 are shown located on the top surface 14 by means of the lugs 20 and are secured to the respective spillage bowl (not shown) by nuts 22. Each of the clamping plates 19 is provided with the inwardly extending fingers 23 to which the base part 9 of the gas burners 2 to 6 is secured. The "U" shaped burner shields 26 are also shown. The gas input connections 25 to each of the base parts 9 are connected via respective gas pipes 27 and via their respective gas control tap 9 to a common gas rail 28 which is fed from a gas supply rail 29. An ignition unit 30 is also provided for providing electronic ignition (not shown) to each of the gas burners 2 to 6.

In the event that the glass top 1 shatters there may be a possibility of the box structure 13 falling through the hole in which it is fitted in a kitchen work surface, but this is prevented by four sideways extending tabs 30 which are pressed out of the top surface 14 of the box structure 13.

It will be appreciated that the cooking hob described, in making use of an open-bottomed construction, overcomes many of the disadvantages which exist in the aforementioned presently available glass top cooking hob. Should the glass top 1 shatter, for example, then the glass is prevented from entering the inside of the appliance by the top surface 14 of the box structure 13, and this will also minimise the effects of any spillage which may occur, and prevent access to any live electrical connections which may exist within the appliance. The fact that the base plate 17 of the appliance is removable enables servicing thereof to be carried out from below without the necessity of disturbing the glass-/work surface seal.

We claim:

1. A cooking hob comprising a glass or similar material top which has a tendency to shatter, a plurality of cooking units disposed in said top, and an open-bottomed box-like structure having a top surface which underlies said top.

2. A cooking hob according to claim 1, comprising at least one gas burner disposed in said top, spillage means disposed around said gas burner, and means for clamping said spillage means to said top surface.

3. A cooking hob according to claim 2, in which the spillage means is clamped to said top surface with said top sandwiched therebetween.

4. A cooking hob according to claim 3, comprising a hole in said top in which said gas burner is disposed, a corresponding hole in said top surface, a clamping member located under said top surface, said gas burner being attached to said clamping member, and means for clamping said clamping member to said spillage means with said top and said top surface sandwiched therebetween.

5. A cooking hob according to claim 2, comprising a burner shield disposed beneath said top surface and at least partially surrounding said gas burner.

6. A cooking hob according to claim 1, comprising a base plate attached to the open bottom of said structure.

* * * * *